US006912982B2

(12) United States Patent
Lehmann et al.

(10) Patent No.: US 6,912,982 B2
(45) Date of Patent: Jul. 5, 2005

(54) DEVICE FOR CHANGING THE ANGLE OF ROTATION OF A CAMSHAFT RELATIVE TO A DRIVE WHEEL OF AN INTERNAL COMBUSTION ENGINE

(75) Inventors: Kai Lehmann, Ludwigsfelde (DE); Timo Schmidt, Stuttgart (DE)

(73) Assignee: DaimlerChrysler A.G., Stuttgart (DE)

( * ) Notice: Subject to any disclaimer, the term of this patent is extended or adjusted under 35 U.S.C. 154(b) by 0 days.

(21) Appl. No.: 10/783,954

(22) Filed: Feb. 20, 2004

(65) Prior Publication Data

US 2004/0187818 A1 Sep. 30, 2004

(30) Foreign Application Priority Data

Feb. 22, 2003 (DE) ..... 103 07 624

(51) Int. Cl.[7] ..... F01L 1/34

(52) U.S. Cl. ..... 123/90.15; 123/90.16; 123/90.17; 123/90.31; 123/90.12; 123/90.34

(58) Field of Search ..... 123/90.31, 90.17, 123/90.12, 90.27, 90.34, 90.38, 193.1, 193.3, 193.5, 195 C, 198 E, 90.15, 90.16

(56) References Cited

U.S. PATENT DOCUMENTS 5,301,639 A * 4/1994 Satou ..... 123/90.17
5,540,197 A * 7/1996 Golovatai-Schmidt et al. .. 123/90.17
5,785,026 A * 7/1998 Moriya ..... 123/90.17
5,803,031 A * 9/1998 Moriya ..... 123/90.34
5,954,019 A * 9/1999 Yoshikawa et al. ..... 123/90.34
6,032,629 A * 3/2000 Uchida ..... 123/90.34
6,035,817 A * 3/2000 Uchida ..... 123/90.17
6,076,492 A * 6/2000 Takahashi ..... 123/90.17
6,289,861 B1 * 9/2001 Suzuki ..... 123/90.17
6,675,752 B1 * 1/2004 Kunne et al. ..... 123/90.17

FOREIGN PATENT DOCUMENTS

| | | |
|---|---|---|
| DE | 40 34 406 | 5/1991 |
| DE | 195 08 505 | 9/1995 |
| DE | 195 02 496 | 8/1996 |
| DE | 694 11 126 | 6/1998 |

* cited by examiner

*Primary Examiner*—Thomas Denion
*Assistant Examiner*—Kyle M. Riddle
(74) *Attorney, Agent, or Firm*—Klaus J. Bach

(57) ABSTRACT

In a device for changing the angle of rotation of a camshaft arranged in a cylinder head of an internal combustion engine relative to a drive wheel of the internal combustion engine, wherein a hydraulic adjusting arrangement is arranged between the drive wheel and the camshaft and is connected to a fluid circuit of the internal combustion engine, and wherein the fluid supply to the adjusting arrangement is controlled by an on/off valve, the on/off valve is mounted near the camshaft and is supplied with fluid via the camshaft.

1 Claim, 1 Drawing Sheet

DEVICE FOR CHANGING THE ANGLE OF ROTATION OF A CAMSHAFT RELATIVE TO A DRIVE WHEEL OF AN INTERNAL COMBUSTION ENGINE

BACKGROUND OF THE INVENTION

The invention relates to a device for changing the angle of rotation of a camshaft arranged in a cylinder head of an internal combustion engine relative to a drive wheel of the internal combustion engine by a hydraulic adjusting arrangement disposed between the drive wheel and the camshaft.

DE 195 02 496 A1 discloses a device of the generic type for changing the timing of an internal combustion engine. The internal combustion engine has a cylinder head in which, a camshaft is mounted, the camshaft being provided at its one end with the device for changing the timing. The device has a hydraulic adjusting arrangement which is subjected to fluid medium in a specific manner via an on/off valve. The camshaft is enclosed in its end region, which faces the device, by a connecting bracket which is connected integrally to a valve housing for accommodating the on/off valve. The connecting bracket is preferably positioned within the cylinder head, specifically directly behind its end wall of the cylinder head which faces the device. This means that the connecting bracket can be arranged only at the front or at the rear end of the camshaft. Oil is supplied to the on/off valve via the end wall of the cylinder head.

Reference is also made to DE 44 06 990 in respect of the general technical background.

It is the object of the invention to provide fluid flow control device by which the fluid supply to a fluid operated device can be controlled in a simple manner and the fluid flow control device can be arranged in different ways.

SUMMARY OF THE INVENTION

In a device for changing the angle of rotation of a camshaft arranged in a cylinder head of an internal combustion engine relative to a drive wheel of the internal combustion engine, wherein a hydraulic adjusting arrangement is arranged between the drive wheel and the camshaft and is connected to a fluid circuit of the internal combustion engine, and wherein the fluid supply to the adjusting arrangement is controlled by an on/off valve, the on/off valve is mounted near the camshaft and is supplied with fluid via the camshaft.

One substantial advantage of the invention is that, because the control device is supplied with fluid via the camshaft, only short fluid lines are necessary. This not only has the positive result that the lines are short and inexpensive to produce, but it also reduces pressure losses so that the comparatively high fluid pressure required for the adjustments in the internal combustion engine can be obtained. According to the invention the fluid is supplied to the control device via the camshaft, which provides for short fluid lines. Furthermore, the number of fluid lines, which would be necessary if the device were supplied with fluid medium from another internal combustion engine component, such as for example the cylinder head, can be reduced.

A further advantage of the invention is that the arrangement of the on/off valve is not restricted to locations at the ends of the camshaft or the end walls of the cylinder head but rather it is only important that it is in the vicinity of the camshaft. As a result, the on/off valve can be arranged in the cylinder head, in the cylinder head cover, in a camshaft bearing or in the crankcase of the internal combustion engine.

The invention will be described below on the basis of the accompanying drawings.

DESCRIPTION OF AN EXEMPLARY EMBODIMENT

Figure 1:
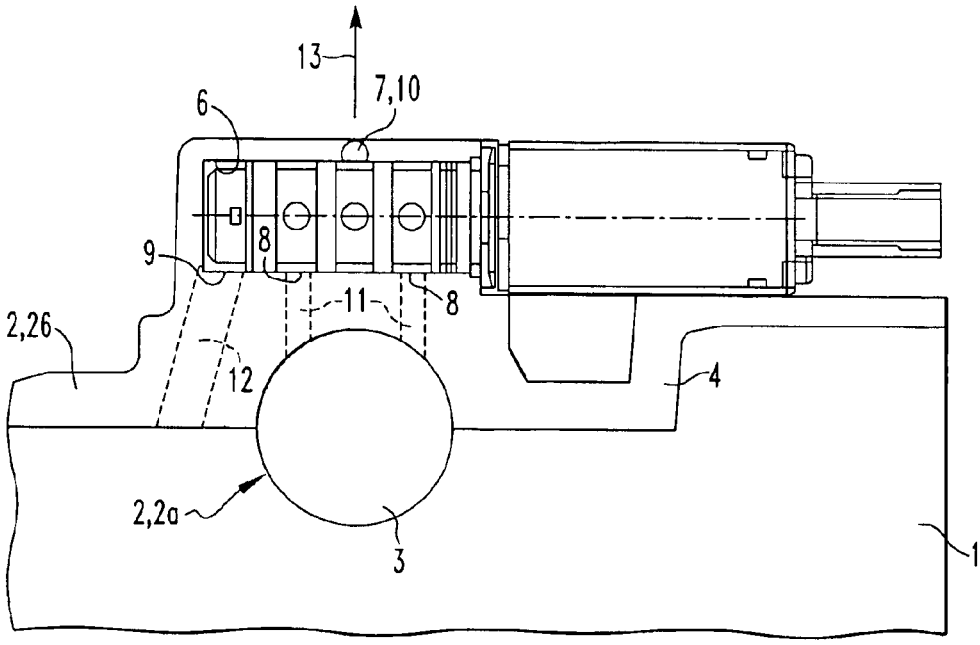
FIG. 1 shows a control valve in close proximity to a fluid supply from which the operating fluid for the operation of the angle adjustment device is derived in a controllable manner.
Figure 2:
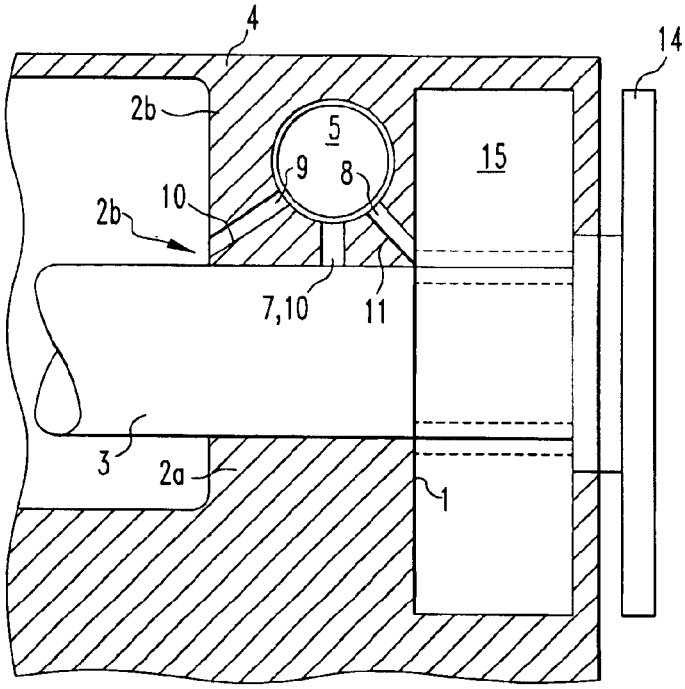
FIG. 2 is a side view of the arrangement shown in FIG. 1.

The figure shows a part of a cylinder head 1 of an internal combustion engine, camshaft bearings 2 for mounting at least one camshaft 3, only one bearing 2 of which can be seen here, and a cylinder head cover 4 which covers the cylinder head 1 and at least one camshaft 3. The cylinder head 1 is disposed on a cylinder block (not illustrated here) of the internal combustion engine.

The camshaft bearings 2 each have a bearing shell 2*a* and a bearing cover 2*b*, the bearing shells 2*a* advantageously being integrally formed on the cylinder head 1 and the bearing covers 2*b* either being separate parts or, as shown here, being formed integrally with the cylinder-head cover 4.

To change the angle of rotation of the camshaft 3 relative to a drive wheel 14 of the internal combustion engine, a hydraulic adjusting arrangement 15 is arranged between the drive wheel and camshaft 3 and is connected to a fluid circuit of the internal combustion engine, the fluid admission being controlled in a specific manner via an on/off valve 5.

In order to make it possible for the device to be supplied with fluid in a simple manner and to make it possible for the device to be arranged in a various ways, the on/off valve 5 is supplied according to the invention with fluid via the camshaft 3.

The on/off valve 5 may be arranged in the cylinder head 1, in one of the camshaft bearings 2, in the cylinder-head cover 4 or in the crankcase of the internal combustion engine. In the present exemplary embodiment, the on/off valve 5 is at least partially integrated in one of the camshaft bearings 2, specifically and advantageously in the bearing cover 2*b* mounted on a bearing shell 2*a* of the camshaft bearing 2. To at least partially accommodate the on/off valve 5, the bearing cover 2*b* has a receiving bore 6 into which the on/off valve 5 can be inserted.

The on/off valve 5 has, as illustrated in the figure by way of example, at least one fluid inlet opening 7, at least one fluid outlet opening 8 for supplying the hydraulic adjusting arrangement with fluid and at least one fluid return-flow opening 9. To supply the hydraulic adjusting arrangement with fluid, the openings 7 to 9 of the on/off valve 5 are connected to fluid bores 10 to 12 which are arranged in the camshaft bearing 2 and can expediently be cast in advance. Depending on the arrangement of the on/off valve 5 within the internal combustion engine, the fluid-bores 10 to 12, however, may also be provided in other internal combustion engine components.

The fluid inlet 10 supplies the on/off valve 5 with fluid via the fluid inlet opening 7. The fluid outlet 11, which is connected to the fluid outlet opening 8, serves to transfer the fluid from the on/off valve 5 to the hydraulic adjusting arrangement 15 and the fluid return line 12 ensures with the fluid return-flow opening 9 that the excess fluid from the on/off valve 5 is returned to the fluid circuit of the internal combustion engine.

The fluid inlet 10 advantageously extends in the direction of a vertical axis 13 of the internal combustion engine and the fluid inlet 7 opens from above or from below into the on/off valve 5.

What is claimed is:

1. A device for changing the angle of rotation of a camshaft (3) arranged in a cylinder head (1) of an internal combustion engine relative to a drive wheel (14) of the internal combustion engine, including a hydraulic adjusting arrangement (15) which is effective between the drive wheel (16) and the camshaft (3) and is connected to a fluid circuit of the internal combustion engine, said camshaft (3) being mounted on said cylinder head by camshaft bearings (2) having a bearing cover **(2*b*) and an on/off spool valve (5) horizontally disposed in said bearing cover (26) so as to extend adjacent the hydraulic adjusting arrangement (15) over, and across, the camshaft (3), said bearing cover further including fluid passages for supplying fluid to, and discharging it from, said hydraulic adjustment arrangement (15) and the on/off spool valve (5) having at least one fluid inlet opening (7) with a fluid inlet line (10) extending essentially vertically between the camshaft (3) and the on/off valve spool (5) disposed in the bearing cover (26) centrally above the camshaft (3) and at least one fluid outlet opening (8) of an outlet passage (11) at one side of the inlet line (10) for supplying the adjacent hydraulic adjusting arrangement with fluid and at least one fluid return-flow opening (9) with an outlet passage (10) disposed at the other side of the inlet line (10)** for returning the hydraulic fluid to the fluid circuit of the internal combustion engine.

* * * * *